US007373894B2

(12) United States Patent
Rowley

(10) Patent No.: US 7,373,894 B2
(45) Date of Patent: May 20, 2008

(54) WINDOW HOUSING FOR USE WITH THRU-HULL FITTINGS

(76) Inventor: Steven Rowley, 40 Birch Hill Rd., York, ME (US) 03909

( * ) Notice: Subject to any disclaimer, the term of this patent is extended or adjusted under 35 U.S.C. 154(b) by 0 days.

(21) Appl. No.: 11/548,051

(22) Filed: Oct. 10, 2006

(65) Prior Publication Data

US 2008/0083360 A1 Apr. 10, 2008

(51) Int. Cl.
*B63B 19/00* (2006.01)

(52) U.S. Cl. ..... 114/173

(58) Field of Classification Search ..... 114/173, 114/177

See application file for complete search history.

(56) References Cited

U.S. PATENT DOCUMENTS 4,346,404 A * 8/1982 Gantenbrink ..... 348/81
4,536,999 A * 8/1985 Eike ..... 52/208
7,044,623 B2 * 5/2006 Olsson et al. ..... 362/477

* cited by examiner

*Primary Examiner*—Stephen Avila
(74) *Attorney, Agent, or Firm*—McHale & Slavin, P.A.

(57) ABSTRACT

Disclosed is a window housing for use in combination with a transducer style thru-hull fitting. The window housing is sealingly attached to the thru-hull fitting by use of a first securement cap. The window housing having a window panel positioned adjacent to the outer side surface of the vessel hull. A tubular shaped light assembly preferably housing LED's may be inserted into the window housing and secured thereto by the use of a second securement cap. Alternatively a tubular shaped camera assembly may be inserted into the window housing and secured thereto by the use of a second securement cap.

32 Claims, 2 Drawing Sheets

WINDOW HOUSING FOR USE WITH THRU-HULL FITTINGS

FIELD OF THE INVENTION

This invention relates to the field of Vessel Thru-Hull Fittings and, more particularly, to a window housing for use with a conventional transducer style thru-hull vessel fitting to permit receipt of an underwater lighting device or camera device.

BACKGROUND OF THE INVENTION

The use of thru-hull is well known. A conventional thru-hull vessel fitting provides an aperture through a side wall of a vessel hull. Current boating techniques require numerous thru-hull fittings above and below the water line. Fitting above the water line include cockpit draining, gray water drains for faucet and showers, anchor closet drains, AC cooling water drains, fish box drains, bilge pump drains and so forth. Thru-hull fittings below the water line are use for main engine cooling intakes, generator engine cooling intakes, air conditioning intakes, head water intakes, fish live well intakes, raw water wash-down intakes, and so forth. Further, conventional thru-hull fitting are used to support electronic devices such a depth and speed transducers.

A conventional transducer thru-hull fitting consists of an externally threaded pipe having a generally smooth inner surface. One end of the threaded pipe includes a flange fitting for securement to the vessel hull, or includes an tapered end if a flush attachment is desired. The flanges are bonded to the vessel by use of an adhesive/sealer, such as 3M 5200, wherein the threaded pipe is permanently mounted at an angle substantially perpendicular to the outer surface of the vessel hull. The inner surface of the pipe provides an open aperture allowing the ingress of water. An electric transducer is place within the aperture providing an uninterrupted access to the water.

The instant inventor employed the use of conventional transducer style thru-hulls fittings for securement of underwater cameras such as that disclosed in U.S. Pat. Nos. 6,100,921 and 6,115,060 the contents of which are incorporated herein by reference.

The use of underwater light is also well known. Underwater lighting is commonly used to attach fish but has also provided entertainment for those that frequent the water, especially pleasure boaters. It is now very common to find lights attached to the hull of a boat for use in illuminating the water while a boat is docked in a marina. The illumination of the water enhancing the safety around the boat, as well as providing entertainment as the lights attach a wide variety of fish.

Current underwater lighting devices employ that are secured to a vessel hull are extremely expensive, primarily due to the speciality thru-hull fitting that is employed. The speciality thru-hull fitting must prevent water entry yet provide an unobstructed window for passage of light from a halogen lamp, Light Emitting Diode (LED) or any other type of lighting element employed.

U.S. Pat. No. 7,044,623 discloses an underwater light requiring a specialty thru-hull vessel fitting. The fitting includes a flange placed on the outside of the vessel hull and an inner flange having a jacking plate. A jacking ring is used to squeeze the hull between the flanges. A window panel is permanently with the outer flange. If the window panel is scratched, breached, or damaged in any manner, replacement of the entire thru-hull is required.

A problem current with underwater lights is not only the cost of manufacturing the speciality housing, but the cost for repairing a speciality thru-hull fitting should any damage occur to the window panel. The window panel on current underwater lights is exposed to the elements at all times. Growth can cover the window requiring a diver to enter the water for cleaning. Entering the water at night, when it is cold, or when the conditions are less than ideal is typically avoided which leads to poor lighting situations.

Even if a diver is used to clean an underwater light having a permanently mounted window, improper handling can quickly damage the current window panels. Divers commonly use paint scrapers to remove barnacles, and sanding pads to reactivate vessel bottoms painted with an ablative paint. Should the diver be careless, the current underwater light housing will be damaged and the boat removed from the water for repair of the damaged window panel. The time and expense associated with lifting a large vessel out the water can add thousands of dollars to the cost of replacement.

Thus, what is needed in the industry is an inexpensive window housing that accepts lighting elements or cameras, and provides a means for servicing of the window housing without removing the vessel from the water.

SUMMARY OF THE INVENTION

The instant invention is a window housing for use with a conventional transducer style thru-hull fitting. The window housing is receptive to an underwater lighting assembly or camera assembly. The window housing is tubular shaped having an outer surface that fits within the conventional transducer thru-hull fitting. The outer surface includes at least one gasket to seal the housing with a transparent window panel along a first end of the housing an a flange located along the length of the housing positioned so as to cause placement of the window panel flush with the outer surface of the vessel hole. Alternatively, the window panel may be dome shaped allowing dispersal of light when a light device is used, or better collection of images when a camera is employed. A first securement cap is used for placing the window housing in a fixed position in relation to the thru-hull fitting.

A light assembly consists of a tubular shaped item having an illumination source such as LED's located along the first end. Alternatively, the illumination source may be a Halogen light, strobe, fiber optic or high intensity discharge (HID) lights. In a preferred embodiment, the LED's are mounted on a support board with the contact inserted through holes. The LED's are wired together and then potted. The LED's are optimally packaged within a cluster to obtain the maximum illumination. The first end of the tubular shaped item is placed into the inner chamber of the window housing wherein the LED's are positioned adjacent to the window pane. Similar to the window housing, a second securement cap is used to securely secure the light assembly inside the window housing. Electrical connections for the LED's extend through the second end of the light assembly and can be connected to the appropriate power source whether it be AC or DC.

It should be noted that the use of a potted LED cluster or lamp prevents water entrance into the vessel even if a catastrophic failure of the window panel occurs.

The light assembly of the instant invention can be inserted or removed from while the vessel is in the water. The light may be pulled for service, color change, or the thru-hull may be used for other uses such as the cameras described in U.S. Pat. No. 6,100,921 or 6,115,060. Further, the use of a domed window panel permits use of a camera that extends beyond the outer side surface of the vessel. The extension permits the use of a directional camera within a sealed environment which eliminated water from contacting the lenses of the camera. The camera may be removed without water ingress, and replaced with a different style or focus camera, a light assembly, or a plug.

In addition, the window housing can be removed even while the through hull is subjected to water pressure. While the pulling of the window housing permits water to pass through the hull, the flow of water can be quickly stopped by replacing the window housing with cap, plug, or transducer while the window housing is being serviced.

Thus an objective of the instant invention is to provide a low cost window housing that can be used with a conventional transducer style thru-hull fitting.

Still another objective of the invention is to provide a low cost window housing receptive to a lighting or camera assembly, or a combination light/camera.

Still another objective of the invention is to provide a window housing that can be removed from inside the vessel for cleaning, replacement, or substitution with other thru-hull mounted devices without special tools or the need to lift the boat out of the water.

Still another objective of the invention is to provide a window housing having a window panel that is flush with an outer surface of a vessel hull, or can be domed allowing for greater dispersal of light or camera angling.

Still another objective of the instant invention is to provide a safety factor that if the window panel should leak the use of a potted light assembly or camera assembly will prevent water from entering the vessel.

Another objective of the invention is to provide an underwater light that can be removed without tools or damaging of the hull.

Still another objective of the invention is to provide an underwater light that can be removed for servicing without tools or water entry in to the vessel, while the vessel is in the water.

Yet still another objective of the invention is to provide an underwater light that can be removed and replace with other lights to vary color, intensity, and temperature.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DESCRIPTION OF THE PREFERRED EMBODIMENT(S)

Although the invention will be described in terms of a specific embodiment, it will be readily apparent to those skilled in this art that various modifications, rearrangements and substitutions can be made without departing from the spirit of the invention. The scope of the invention is defined by the claims appended hereto. For clarity of this specification, the embodiment described will detail the use of a lighting assembly for use in combination with the window housing of the instant invention.

Figure 1:
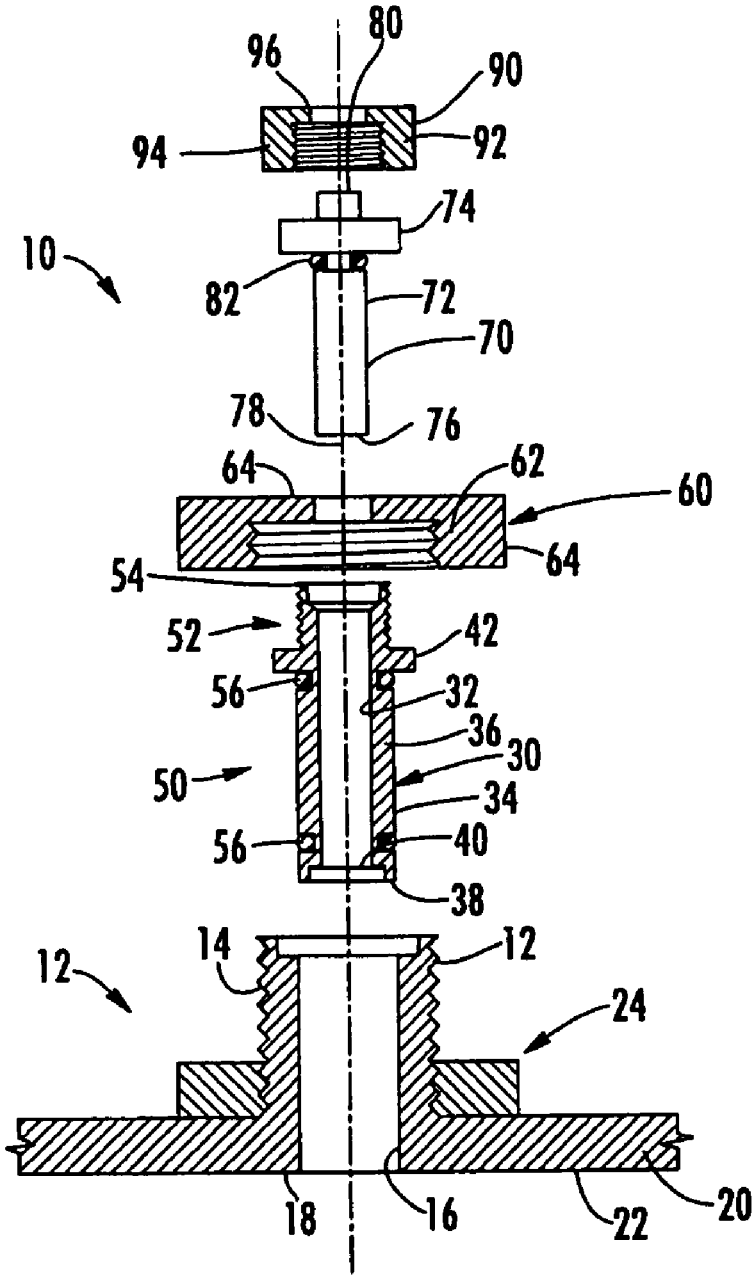
FIG. 1 is an exploded cross sectional view of the window housing in combination with a lighting assembly.
Figure 3:
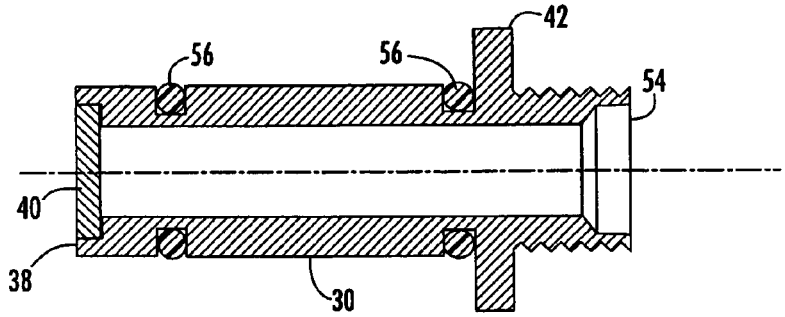
FIG. 3 is a cross sectional side view of the window housing.
Figure 2:
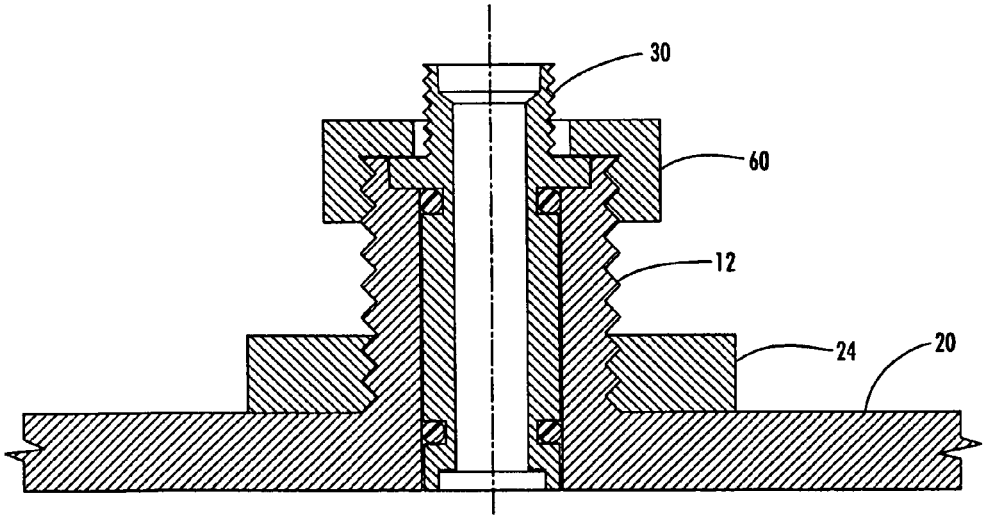
FIG. 2 is cross sectional side view illustrating the window housing secured to thru-hull fitting.

Now referring to the Figures, set forth is the first embodiment of the invention showing a lighting apparatus 10 for use in combination with a transducer style thru-hull fitting 12. The thru-hull fitting consists of a tubular shaped externally threaded pipe fitting 14 having a generally smooth inner surface 16. The thru-hull fitting has a first end 18 that is bonded to a vessel hull 20 typically by use of a flange such as that depicted in FIG. 1 to provide a flush mount with the outer surface 22 of the vessel hull 20. The flange 18 may be mounted on the outer surface 22 of the vessel hull 20 wherein it operates as an enlarged head. The thru-hull is typically mounted with an adhesive/sealant such as 3M 5200 adhesive for permanently bonding the thru-hull to the vessel hull. A thru-hull fitting is then further secured by use of a fitting nut 24 which is treaded to the thru-hull fitting for stabilization of the thru-hull fitting, the adhesive causes a permanent bonding to the vessel hull.

A conventional thru-hull fitting works as a receptacle for receipt of numerous types of inserts including transducers used for depth finders, paddle wheels used for speed indicators, and camera assemblies. The preferred embodiment employs a first tubular shaped window housing 30 having an inner surface 32 and outer surface 34 forming a continuous side wall 36. The first end 38 of the window housing includes a transparent window 40 that is sealingly attached to the side wall 36 providing a water tight seal between the window and the inner surface 32. The window is a transparent panel constructed from glass, sapphire, acrylic, or polycarbonate resin. A reflective coating may be used to provide directional or dispersal effects. For example, the inner surface of the panel may include a prismatic film to provide light and color changes. The window may also be tinted or include a light diffuser. The first flange 42 is formed interval to the side wall 36 and extends outward from outer surface 34 thereby defining a lower end 50 which extends from first end 38 to the bottom of the first flange 42 and a upper end 52 extending from a second end 54 and extending to the top of said first flange 42.

The first flange 42 is strategically mounted along the side wall so as to allow insertion into a thru-hull fitting so as to cause the window 40 to be flush with the outer surface 22 of the vessel hull 20 upon insertion of the window sleeve into the thru-hull fitting. O-rings 56 are providing along the length of the outer surface so as to cause a seal between the outer surface 34 and the inner surface 16 of the thru-hull fitting. The window housing is preferably constructed from sidewall can be constructed from a non-ferrous material such as plastic but may also be constructed from aluminum, titanium, stainless steel, bronze, or combinations thereof.

A first securement cap 60 having an inner surface 62 and an outer surface 64. The inner surface 62 is treaded so as to provide a engagement with threaded surface 14 of the thru-hull fitting 12. The first securement cap providing a releasable attachment to the thru-hull fitting. The securement cap 60 including a lip 64 extending inwardly from the inner surface 62 to form a centrally disposed aperture that is sized to fit over the upper end 54 and engage the flange 42 thereby sandwiching the flange 42 between the thru-hull fitting 12 and the securement cap 60. Upon assembly the window housing and the thru-hull fitting become a unitary structure that prevents water from entering through the thru-hull by the barrier caused from the window 38 and O-rings 56.

The light assembly 70 consists of a tubular shaped shell having an outer side surface 72 including a second flange 74 formed integral thereto and extended outwardly therefrom. The first end 76 of the light assembly 70 is sized and arranged for insertion into the window sleeve housing 30 along the inner surface 32 of the window assembly 60. The light assembly 70 has an inner surface 78 wherein a purality of LED's are positioned. Preferably the electrical coupling wires are potted within the housing and extend outwardly from the second end 80. The length of the light assembly positions the first end 76 with the LED lamps adjacent to the window panel 40 of the window assembly placing the lamps adjacent to the outer surface 22 of the vessel hull 20 for optimum illumination of the water. Alternatively, the illumination source may be a Halogen light, strobe, fiber optic or high intensity discharge (HID) lights.

In a similar fashion as the window assembly, the second flange 74 positions the first end 76 adjacent to the window and rests on the upper end 54 of the window assembly O-ring 82 providing a seal along inner surface 32. It should be noted that the window assembly 30 provides a seal between the outside of the vessel and the inside of the vessel wherein the light assembly O-ring 82 provides a secondary seal if there is a catastrophic failure of the window assembly wherein loss of the window panel 40 and/or O-rings 56 occur. O-ring 82 provides a secondary seal and the LED's being potted within the light assembly prevent water passage. The O-rings used in the light assembly and window assembly are formed from a resilient member such as natural or synthetic elastomers, nitrile rubber, fluoroelastomers or silicone.

A second securement cap 90 having an inner surface 92 and an outer surface 94 is used for engagement to the upper end 52 of the window assembly 30. The inner surface 92 is treaded which permits the releasable attachment to the treaded upper end of the window assembly. The securement cap 90 including a lip 96 extending inwardly from the inner surface 92 to form a centrally disposed aperture which is sized to allow the threaded end of the window assembly to pass there through. The lip 96 engaging the flange 74 attachment to the window assembly to prevent any movement.

The light assembly 70 is removed by un-threading the second securement cap 90 from the window housing 30. The light assembly 70 can then be pulled out of the window housing 30 and replaced with a light assembly of another type e.g. halogen lamp, colored LED's and so forth. Alternatively the light assembly may be replaced with a camera, not shown, or light/camera combination.

The window assembly 30 may be removed by un-threading the first securement cap 60 from the thru-hull fitting 12. The window housing can then be pulled from the thru-hull fitting for servicing of the window panel 40 or allowing insertion of a pass thru camera, not shown, that extends outwardly from the outer surface 22 of the vessel hull 20.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

I claim:

1. A window housing for use in combination with a transducer style thru-hull fitting, said window housing comprising a tubular shaped shell sized and arranged for insertion into said transducer thru-hull fitting, said shell is defined by an inner surface and an outer surface forming a continuous sidewall therebetween with a window sealed to a first end of said shell and an opening formed at a second end, said shell having a first flange formed integral to said outer surface of said sidewall and extending outwardly therefrom defining a lower end extending from said first end to said flange sized and arranged for sealable insertion into said thru-hull fitting, and an upper end extending from said second end to said flange having external threads, said second end receptive to a camera, lighting device, or combination thereof; whereby said window provides a viewing port through said fitting.

2. The window housing according to claim 1 wherein said means for securing said window housing is further defined as a first securement cap having an inner surface and an outer surface, said inner surface threaded to permit the releasable attachment to said threaded upper end of said thru-hull fitting, said securement cap having a lip extending inwardly from said inner surface to form a centrally disposed aperture sized to allow said threaded upper end to extend therethrough, said lip engaging said flange upon attachment of said first securement cap to said thru hull fitting to inhibit movement.

3. The window housing according to claim 1 wherein said lighting device is defined by a tubular shell having an outer side surface including a second flange formed integral thereto and extending outwardly therefrom, a first end of said light assembly sized and arranged for insertion into said inner surface of said window housing, said first end having an outer surface sized and arranged for sealable insertion into said window housing, said second end of said lighting device having external threads; and a means for securing said light device to said window assembly.

4. The window housing according to claim 1 wherein said window panel is aligned with said thru-hull fitting to position said window panel flush with an outer side surface of the vessel hull.

5. The window housing according to claim 1 wherein said window panel is dome shaped and extends outwardly from said thru-hull fitting to protrude said window panel along an outer side surface of the vessel hull.

6. The window housing according to claim 1 wherein said window panel includes a reflective coating.

7. The window housing according to claim 1 including at least one resilient member constructed and arranged so as to provide a watertight seal with said thru-hull fitting.

8. The lighting assembly according to claim 3, wherein said illumination means is at least one light emitted diode.

9. The lighting assembly according to claim 3, wherein said illumination means is a halogen lamp.

10. A lighting apparatus for use in combination with a transducer shaped thru-hull fitting, said light apparatus comprising: a window housing sized and arranged for insertion into said thru-hull fitting said window housing has an inner surface and an outer surface forming a continuous sidewall therebetween with a window sealed to a first end and an opening formed at a second end, means for securing said window housing to said thru-hull fitting; a light assembly sized and arranged for insertion into said window housing, said light assembly having an inner surface fitted with an illumination means; means for securing said light assembly to said window housing; a first flange formed integral to said outer surface of said sidewall and extending outwardly therefrom defining a lower end extending from said first end to said flange sized and arranged for sealable insertion into said thru-hull fitting, and an upper end extending from said second end to said flange having external threads, whereby said light assembly provides underwater illumination.

11. The lighting apparatus according to claim 10 wherein said means for securing said window housing is further defined as a first securement cap having an inner surface and an outer surface, said inner surface threaded to permit the releasable attachment to said threaded upper end of said thru-hull fitting, said securement cap having a lip extending inwardly from said inner surface to form a centrally disposed aperture sized to allow said threaded upper end to extend therethrough, said lip engaging said flange upon attachment of said first securement cap to said thru hull fitting to inhibit movement.

12. The lighting apparatus according to claim 10 wherein said light assembly includes an outer side surface including a second flange formed integral thereto and extending outwardly therefrom, a first end of said light assembly is sized and arranged for insertion into said inner surface of said window housing, said first end having an outer surface sized and arranged for sealable insertion into said window housing, said second end of said light assembly having external threads.

13. The lighting apparatus according to claim 10 wherein said means for securing said light assembly to said window assembly is a second securement cap having an inner surface and an outer surface, said inner surface threaded to permit the releasable attachment to said threaded second end of said window assembly, said securement cap having a lip extending inwardly from said inner surface to form a centrally disposed aperture sized to allow said threaded second end of said window assembly to pass therethrough, said lip engaging said flange upon attachment of said second cap to said window assembly to inhibit movement.

14. The lighting apparatus according to claim 10 wherein said window panel is aligned with said thru-hull fitting to position said window panel flush with an outer side surface of the vessel hull.

15. The lighting apparatus according to claim 10, wherein said window housing sidewall is constructed from a material selected from the group consisting of aluminum, stainless steel, titanium, bronze, plastic or combinations thereof.

16. The lighting apparatus according to claim 10, wherein said transparent panel is constructed from a material selected from the group consisting of glass, sapphire, acrylic, or polycarbonate resin.

17. The lighting apparatus according to claim 10 wherein said illumination means is positioned adjacent to said window panel.

18. The lighting apparatus according to claim 10 wherein said window panel includes a reflective coating.

19. The lighting apparatus according to claim 10 wherein said window housing includes at least one resilient member constructed and arranged so as to provide a watertight seal with said thru-hull fitting.

20. The lighting assembly according to claim 10, wherein said resilient member is constructed from a material selected from the group consisting of natural or synthetic elastomers, nitrile rubber, fluoroelastomers or silicone.

21. The lighting assembly according to claim 10, wherein said illumination means is at least one light emitted diode.

22. The lighting assembly according to claim 10, wherein said illumination means is a halogen lamp.

23. A lighting apparatus for use in combination with a tubular shaped thru-hull fitting defined as an externally threaded pipe having a generally smooth inner surface wherein one end of said threaded pipe is bonded to a vessel hull at an angle substantially perpendicular to the outer side surface of the vessel hull providing an open aperture extending through said vessel hull, said light apparatus comprising:

a tubular shaped window housing having an inner surface and an outer surface forming a continuous sidewall therebetween, said window housing having a transparent window sealing a first end and an open second end, a first flange formed integral to said outer surface of said sidewall and extending outwardly therefrom defining a lower end extending from said first end to said flange sized and arranged for sealable insertion into said thru-hull fitting, and an upper end extending from said second end to said flange having external threads;

a first securement cap having an inner surface and an outer surface, said inner surface threaded to permit the releasable attachment to said threaded upper end of said thru-hull fitting, said securement cap having a lip extending inwardly from said inner surface to form a centrally disposed aperture sized to allow said threaded upper end to pass therethrough, said lip engaging said flange upon attachment of said first securement cap to said thru hull fitting to inhibit movement;

a tubular shaped light assembly having an outer side surface including a second flange formed integral thereto and extending outwardly therefrom, a first end of said light assembly is sized and arranged for insertion into said inner surface of said window housing, said first end having an outer surface sized and arranged for sealable insertion into said window housing and an inner surface fitted with an illumination means, said second end of said light assembly having external threads;

a second securement cap having an inner surface and an outer surface, said inner surface threaded to permit the releasable attachment to said threaded second end of said window assembly, said securement cap having a lip extending inwardly from said inner surface to form a centrally disposed aperture sized to allow said threaded second end of said window assembly to pass therethrough, said lip engaging said flange upon attachment of said second cap to said window assembly to inhibit movement;

whereby said light assembly provides underwater illumination.

24. The lighting apparatus according to claim 23 wherein said window panel is aligned with said thru-hull fitting to position said window panel flush with an outer side surface of the vessel hull.

25. The lighting apparatus according to claim 23, wherein said window housing sidewall is constructed from a material selected from the group consisting of aluminum, stainless steel, titanium, bronze, plastic or combinations thereof.

26. The lighting apparatus according to claim 23, wherein said transparent panel is constructed from a material selected from the group consisting of glass, sapphire, acrylic, or polycarbonate resin.

27. The lighting apparatus according to claim 23 wherein said illumination means is positioned adjacent to said window panel.

28. The lighting apparatus according to claim 23 wherein said window panel is a includes a reflective coating.

29. The lighting apparatus according to claim 23 wherein said window housing includes at least one resilient member constructed and arranged so as to provide a watertight seal with said thru-hull fitting.

30. The lighting assembly according to claim 23, wherein said resilient member is constructed from a material selected from the group consisting of natural or synthetic elastomers, nitrile rubber, fluoroelastomers or silicone.

31. The lighting assembly according to claim 23, wherein said illumination means is at least one light emitting diode.

32. The lighting assembly according to claim 23, wherein said illumination means is a halogen lamp.

* * * * *